US007156114B2

(12) United States Patent
Lo

(10) Patent No.: US 7,156,114 B2
(45) Date of Patent: Jan. 2, 2007

(54) ANGLE ADJUSTING DEVICE FOR THE CANOPY OF A HANG UMBRELLA

(76) Inventor: Chong-Yi Lo, 3500, Valley Meadow Rd., Sherman Oaks, CA (US) 91403

( * ) Notice: Subject to any disclaimer, the term of this patent is extended or adjusted under 35 U.S.C. 154(b) by 147 days.

(21) Appl. No.: 11/047,698

(22) Filed: Feb. 2, 2005

(65) Prior Publication Data

US 2006/0169307 A1 Aug. 3, 2006

(51) Int. Cl.
*A45B 11/00* (2006.01)
*E04H 15/28* (2006.01)

(52) U.S. Cl. ..... 135/21; 135/20.1; 135/20.3; 135/98; 403/292; 403/164

(58) Field of Classification Search ..... 135/20.1, 135/20.3, 21, 23, 90, 98, 15.1; 403/286, 403/292, 308, 164–165
See application file for complete search history.

(56) References Cited

U.S. PATENT DOCUMENTS 4,998,551 A * 3/1991 DeSarno ..... 135/15.1
5,116,258 A * 5/1992 Vennik ..... 135/20.3
5,149,149 A * 9/1992 Wu ..... 285/402
5,845,665 A * 12/1998 Koehn ..... 135/98
5,937,882 A * 8/1999 Harbaugh ..... 135/20.3
5,960,806 A * 10/1999 Steiner ..... 135/20.1
6,152,156 A * 11/2000 Tung ..... 135/21
6,196,242 B1 * 3/2001 Xu ..... 135/20.1
6,401,739 B1 * 6/2002 Bright et al. ..... 135/98
6,588,438 B1 * 7/2003 Steiner ..... 135/20.1
6,619,306 B1 * 9/2003 Ma ..... 135/21

FOREIGN PATENT DOCUMENTS

FR 2737244 * 1/1996

* cited by examiner

*Primary Examiner*—Winnie Yip
(74) *Attorney, Agent, or Firm*—Bacon & Thomas PLLC

(57) ABSTRACT

An angle adjusting device for the canopy of a hang umbrella includes a cantilever divided into a left-sectional cantilever and a right-sectional cantilever, with a connecting plug inserted in between the interiors of the left-sectional and the right-sectional cantilever. The left-sectional cantilever is secured with one end of the connecting plug and the right-sectional cantilever fitted around the other end of the connecting plug by a tightening bolt. By so designing, the outer portion of the cantilever, which is connected with the canopy, can be rotated and adjusted in different angles. Thus, the canopy of the hang umbrella can be adjusted and turned forward and backward as well as leftward and rightward.

4 Claims, 8 Drawing Sheets

(B-B)

ANGLE ADJUSTING DEVICE FOR THE CANOPY OF A HANG UMBRELLA

BACKGROUND OF THE INVENTION

1. Field of the Invention

This invention relates to an angle adjusting device for the canopy of a hang umbrella, particularly to one enabling the canopy of a hang umbrella to be turned forward and backward as well as leftward and rightward.

2. Description of the Prior Art

A conventional hang umbrella, as shown in FIG. 1, includes a shank 10 having its upper end movably connected with a pull rod 11 and its upper half portion provided with a slide ring 12 able to shift and position thereon. The slide ring 12 has its side wall pivotally connected with a cantilever 13 extending outward and having its intermediate portion pivotally connected with the outer end of the pull rod 11 that has strength to pull upward the outer end of the cantilever 13. The cantilever 13 has its outer end bent downward and connected with the canopy 14 of the hang umbrella, letting the canopy 14 face downward.

However, the canopy 14 of the conventional hang umbrella can only be adjusted to face or have its back facing the shank 10 by shifting the slide ring 12 upward or downward, as shown in FIG. 1B and 1C, but cannot be turned toward the left or right side of the shank 10.

SUMMARY OF THE INVENTION

The objective of the invention is to offer an angle adjusting device for the canopy of a hang umbrella, able to adjust the canopy of a hang umbrella to turn forward and backward as well as leftward and rightward.

The feature of the invention is a cantilever divided into a left-sectional cantilever and a right-sectional cantilever, with a connecting plug inserted in between the interiors of the left sectional and the right-sectional cantilever. The left-sectional cantilever is secured in one end of the connecting plug and the right-sectional cantilever is fitted in the other end of the connecting plug and fixed therein by a tightening bolt. By so designing, the left-sectional cantilever connected with the canopy of the hang umbrella can be turned and adjusted in angles, and the canopy of the hang umbrella can be adjusted and turned forward and backward as well as leftward and rightward.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
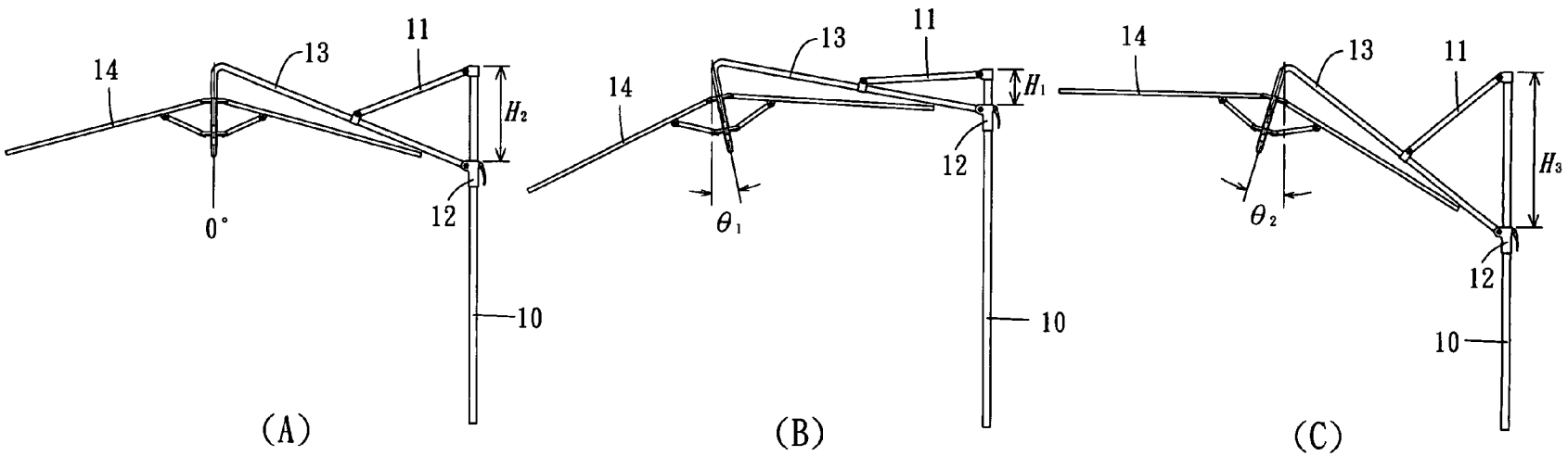
FIG. 1 (PRIOR ART)
FIGS. 1A, 1B and AC are side views of a conventional hang umbrella having its canopy adjusted at different angles.
Figure 2:
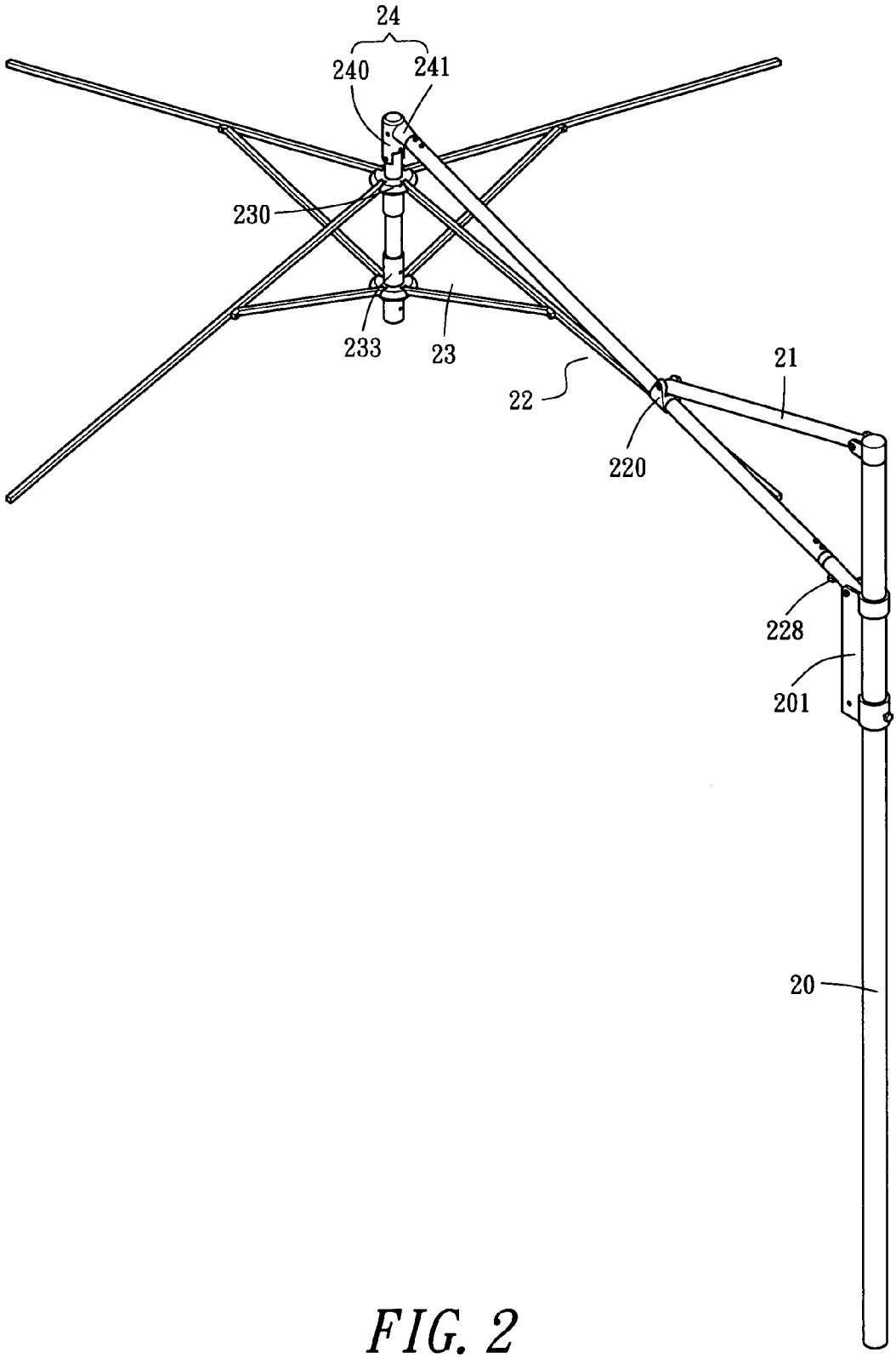
FIG. 2 is a perspective view of a hang umbrella in the present invention.

A preferred embodiment of an angle adjusting device for the canopy of a hang umbrella in the present invention, as shown in FIGS. 1 and 2, includes a shank 20, a pull rod 21, a cantilever 22, a canopy 23, a top cover 24 and a pull rope 25 combined together.

The shank 20 has its upper intermediate portion provided with a slide ring 20 able to shift and positioned thereon, with a tightening bolt inserted in the sidewall of the slide ring 201.

The pull rod 21 has one end pivotally connected with the upper end of the shank 20 and the other end extending outward.

Figure 3:
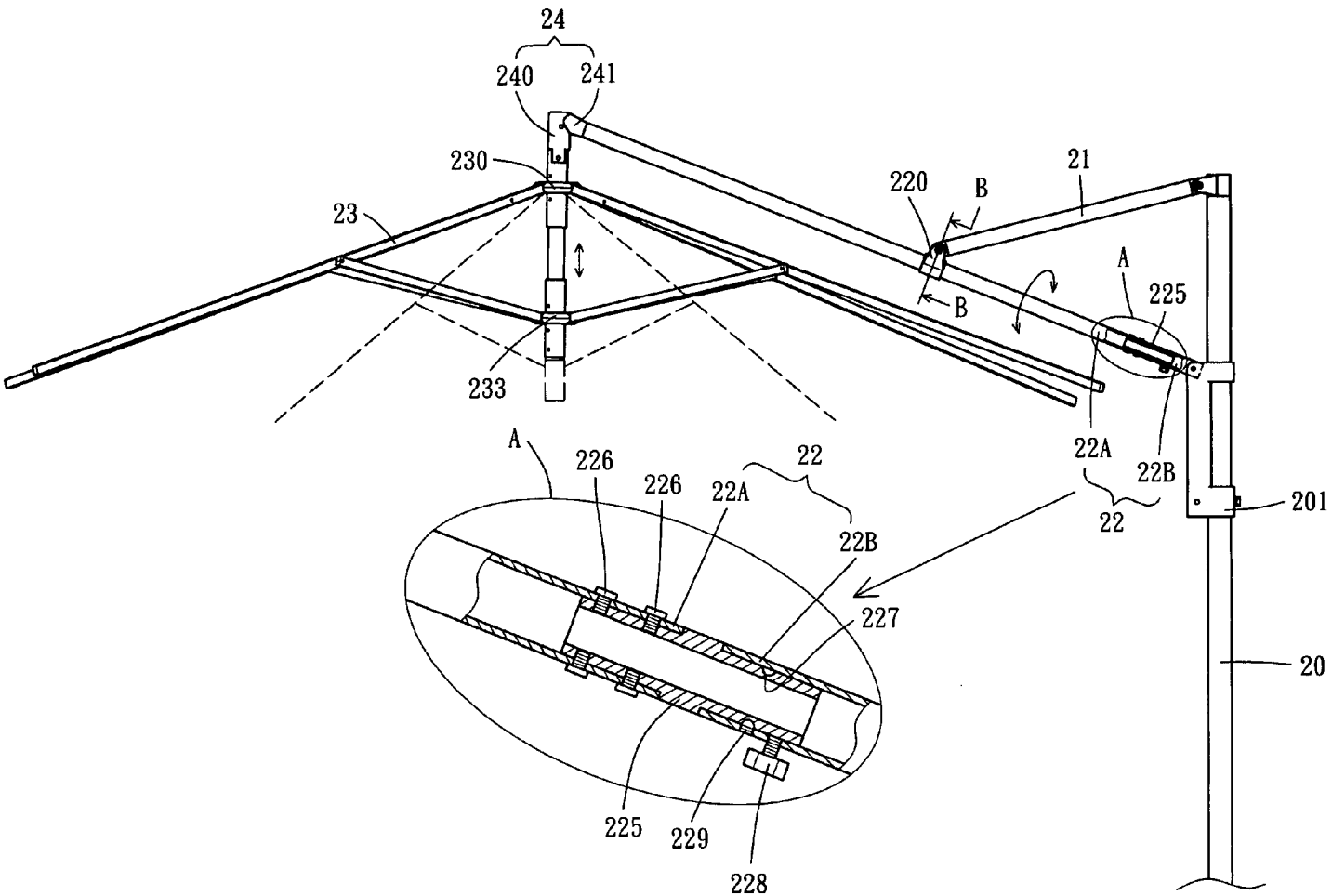
FIG. 3 is a side view of the hang umbrella in the present invention.
Figure 4:
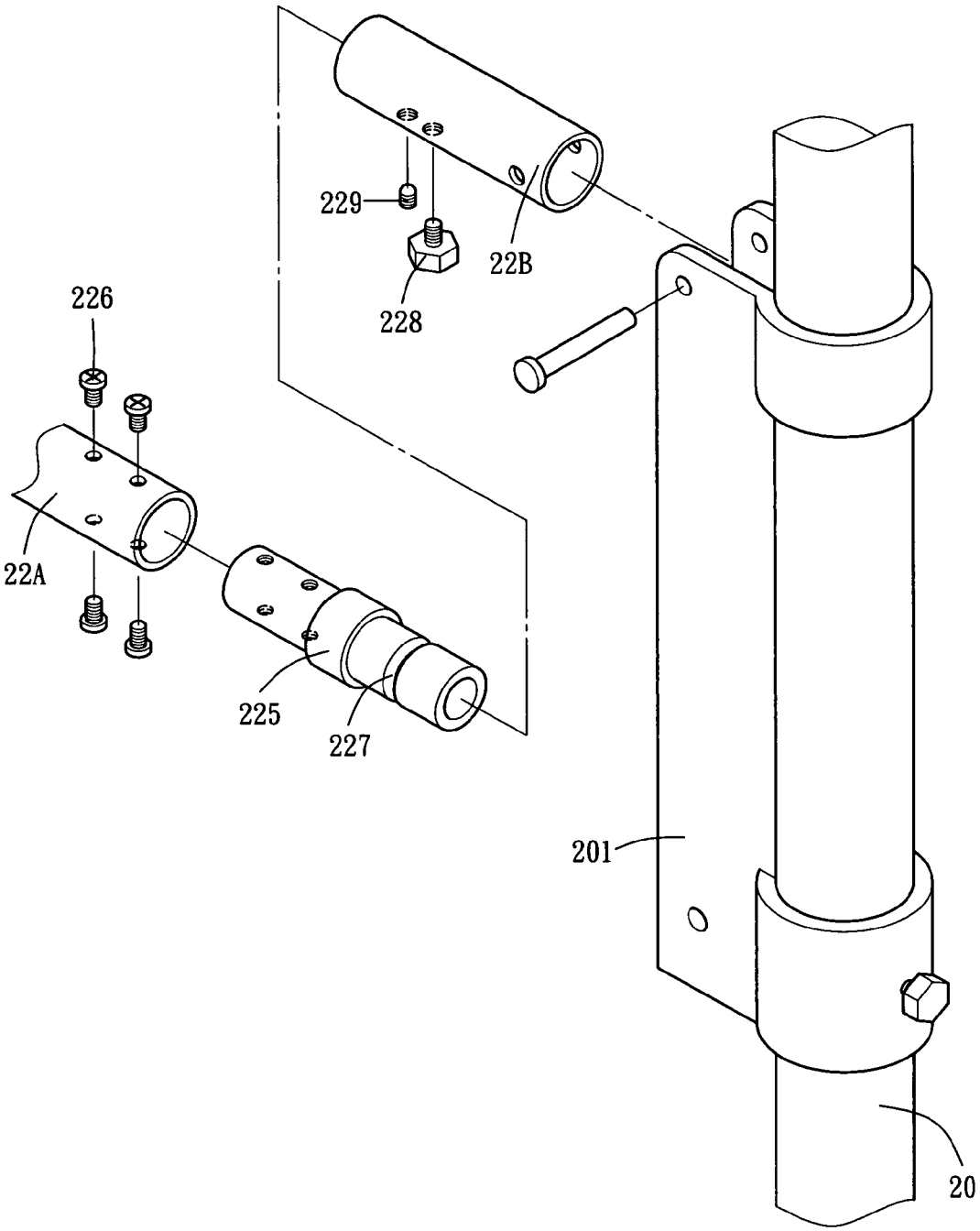
FIG. 4 is a partial exploded perspective view of the hang umbrella in the present invention.
Figure 7:
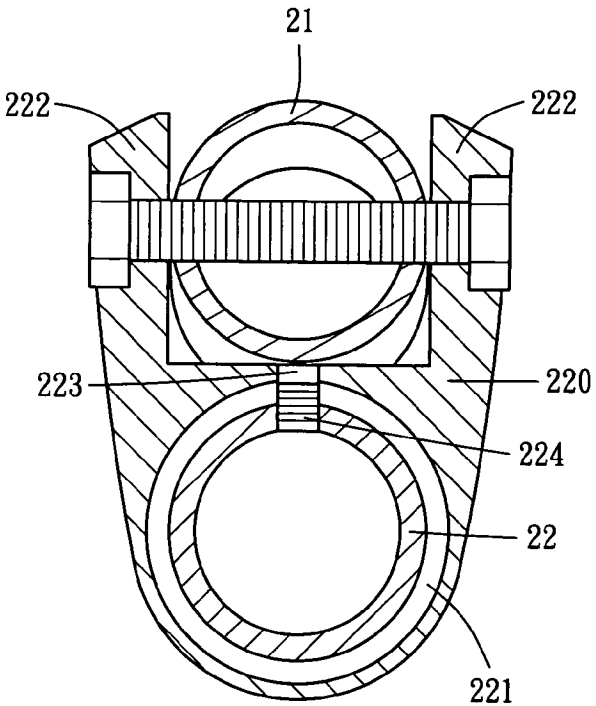
FIG. 7 is a cross-sectional view of the line B—B in FIG. 3.
Figure 6:
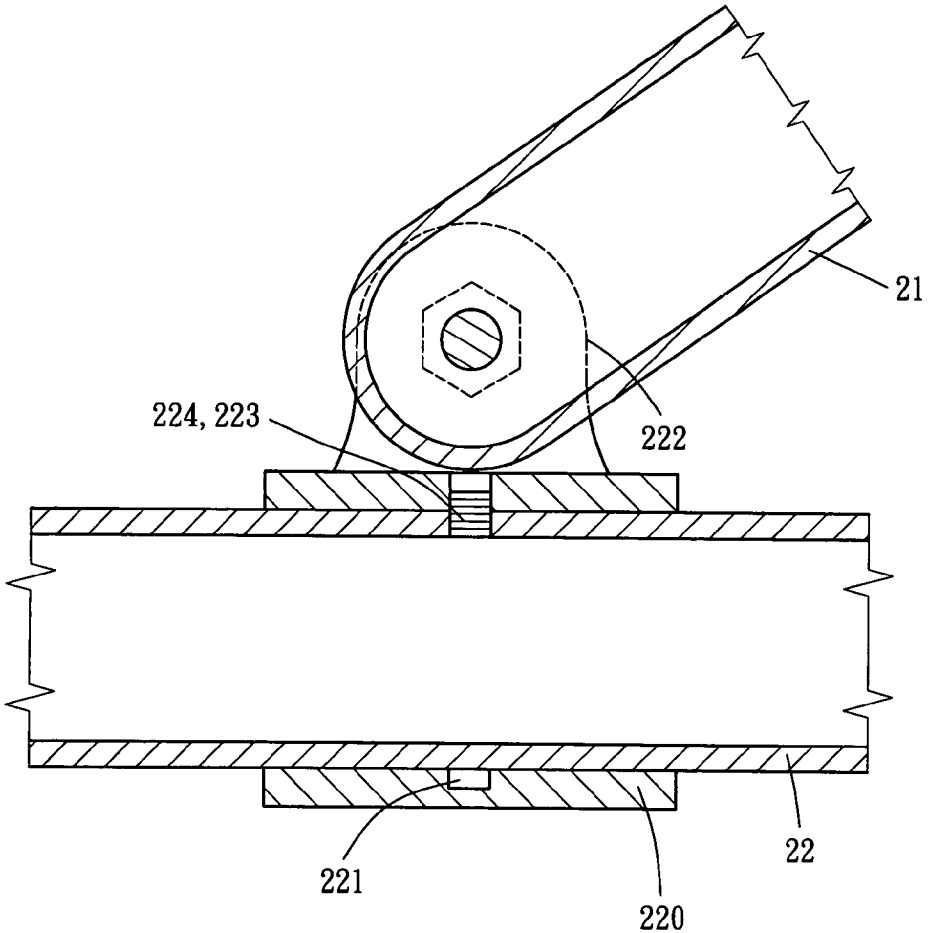
FIG. 6 is a side cross-sectional view of a hollow sleeve in an assembled condition in the present invention.

The cantilever 22, as shown in FIGS. 3 and 4, has one end pivotally connected with the upper end of the slide ring 201 and its intermediate portion fixed thereon with a hollow sleeve 220 having its inner wall bored with an annular recess 221, as shown in FIGS. 6 and 7. The hollow sleeve 220 has its upper surface extending upward to form two connecting wings 222 for the extending end of the pull rod 21 to be pivotally connected therebetween. The hollow sleeve 220 further has its outer side bored with an insert hole 223 communicating with the annular recess 221 for a positioning bolt 224 to be inserted therein from the outer side of the hollow sleeve 220 to fix the hollow sleeve 220 on the outer wall of the cantilever 22. The positioning bolt 224 has its lower end extending in the annular recess 221 of the hollow sleeve 220 so that the hollow sleeve 220 can be positioned on the cantilever 22, which can be turned around inside the hollow sleeve 220 for adjusting its angles. The cantilever 22 has the portion between the slide base 201 and the hollow sleeve 220 divided into a left-sectional cantilever 22A and a right-sectional cantilever 22B, with a connecting plug 225 inserted in between the interiors of the left-sectional and the right-sectional cantilever 22A, 22B. The connecting plug 225 has one end secured in the left-sectional cantilever 22A by bolts 226 and the other end bored with an annular recess 227 around its outer wall, as shown in FIG. 4, and inserted in the right-sectional cantilever 22B, with a tightening bolt 228 inserted inward from the outer side of the right-sectional cantilever 22B to push against the outer wall of the connecting plug 225 to prevent it from rotating. In addition, a connecting bolt 229 is inserted inward from the outer side of the right-sectional cantilever 22B to get in the annular recess 227 of the connecting plug 225 not for tightening the right-sectional cantilever 22B but for preventing the connecting plug 225 and the right-sectional cantilever 22B from disengaging from each other.

Figure 5:
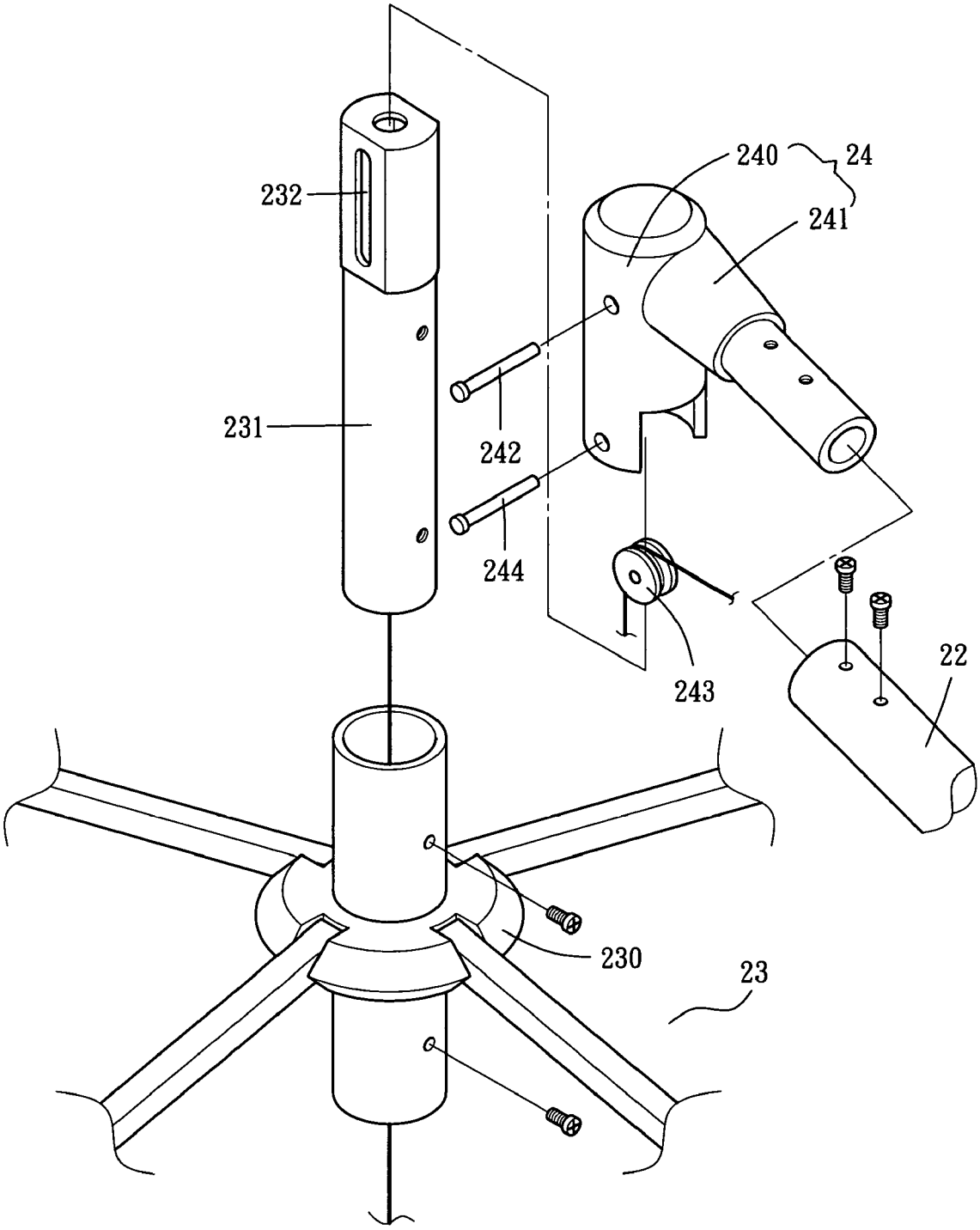
FIG. 5 is another partial exploded perspective view of the hang umbrella in the present invention.

The canopy 23, as shown in FIG. 5, fixed at the outer end of the cantilever 22 is provided in the center with an upper rib holder 230 having its upper end connected with a vertical combining tube 231 having the opposite side walls of its upper portion respectively cut with a vertical slide slot 232.

The top cover 24 consists of a vertical hollow main cover 240 and a connecting tube 241 extending outward obliquely from the sidewall of the main cover 240 for connecting the cantilever 22. A rope pulley 243 is pivotally received in the upper interior of the main cover 240 by an insert pin 242, and the combining tube 231 of the canopy 23 has its upper end inserted in the lower interior of the main cover 240. Further, the main cover 240 has its outer wall bored with an insert hole matching with the slide slot 232 of the combining tube 231 for a locking member 244 to be inserted therethrough and get in the slide slot 232.

The pull rope 25 is fastened with the slide base 201 and passes through the interiors of the cantilever 22 and the connecting tube 241 and the rope pulley 243 as well as the main cover 240 and the combining tube 231 and the upper umbrella rib holder 230 of the canopy 23 and finally connected with a lower rib holder 233. Thus, when the slide ring 201 is moved downward and have the pull rope 25 pulled tight, the upper and the lower rib holder 230, 233 will closed together, and the upper end of the combining tube 231 and the main cover 240 will be closely engaged with each other, letting the canopy 23 stretched open. On the contrary, when the slide base 201 is moved upward to loosen the pull rope 25, the upper end of the combining tube 231 and the main cover 240 will be disengaged, and the upper and the lower rib holder 230, 233 will be separated from each other. At this time, the ribs of the canopy 23 will move downward to collapse the canopy 23.

After assembled, as shown in FIG. 3, the angle adjusting device for the canopy of a hang umbrella of this invention can be operated in the following ways.

Figure 8:
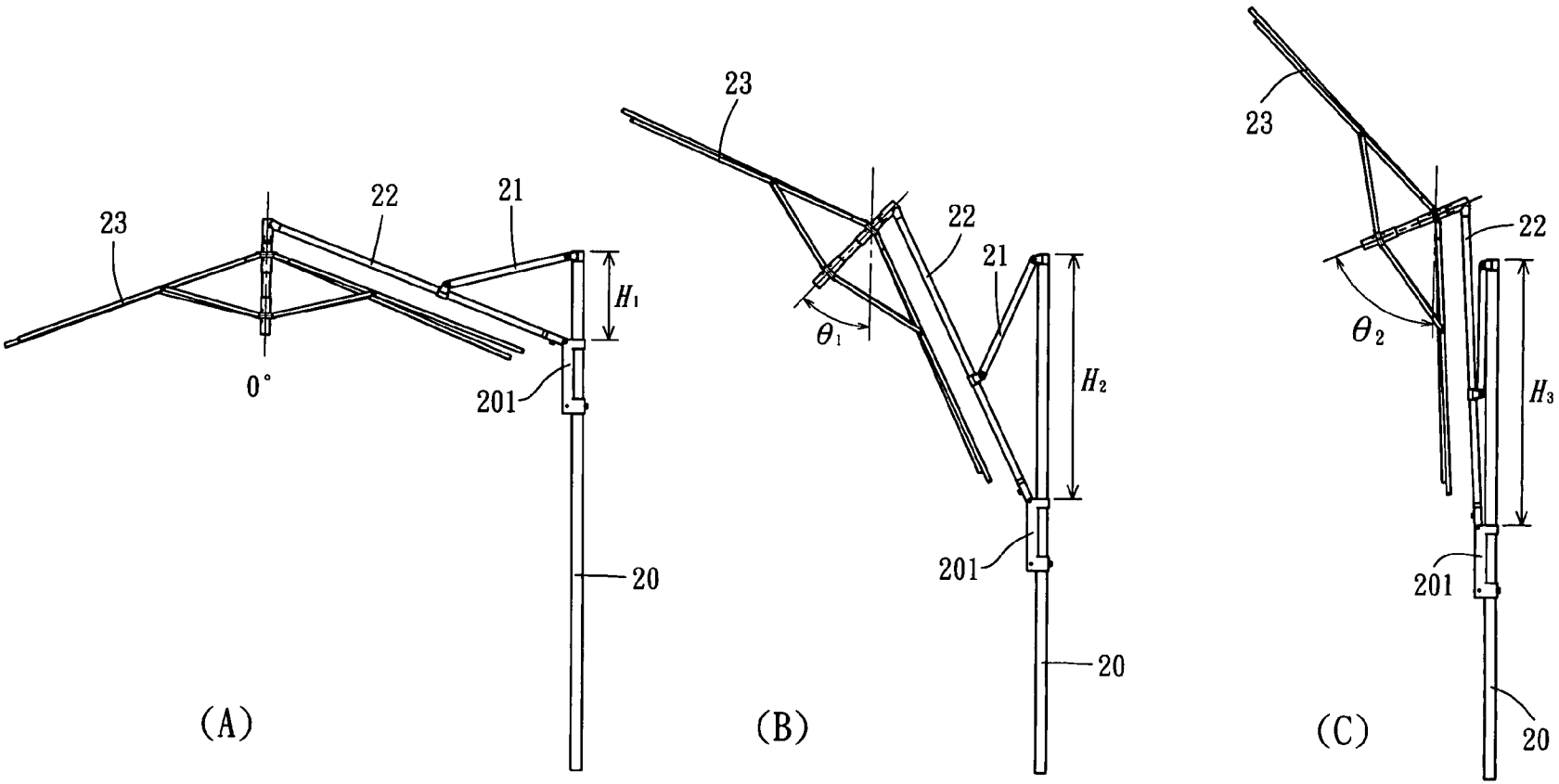
FIGS. 8A, 8B and 8C are side cross-sectional views of the hang umbrella having its canopy adjusted in various angles in the present invention.

1. When the canopy 23 is to be adjusted to face or have its back facing the shank 20, as shown in FIG. 8, simply loosen the slide base 201 on the upright support post 20 and then moved it upward or downward, as shown in FIG. 8B and 8C. After the canopy 23 is adjusted to an appropriate angle, the slide ring 201 is firmly positioned on the shank 20.

Figure 9:
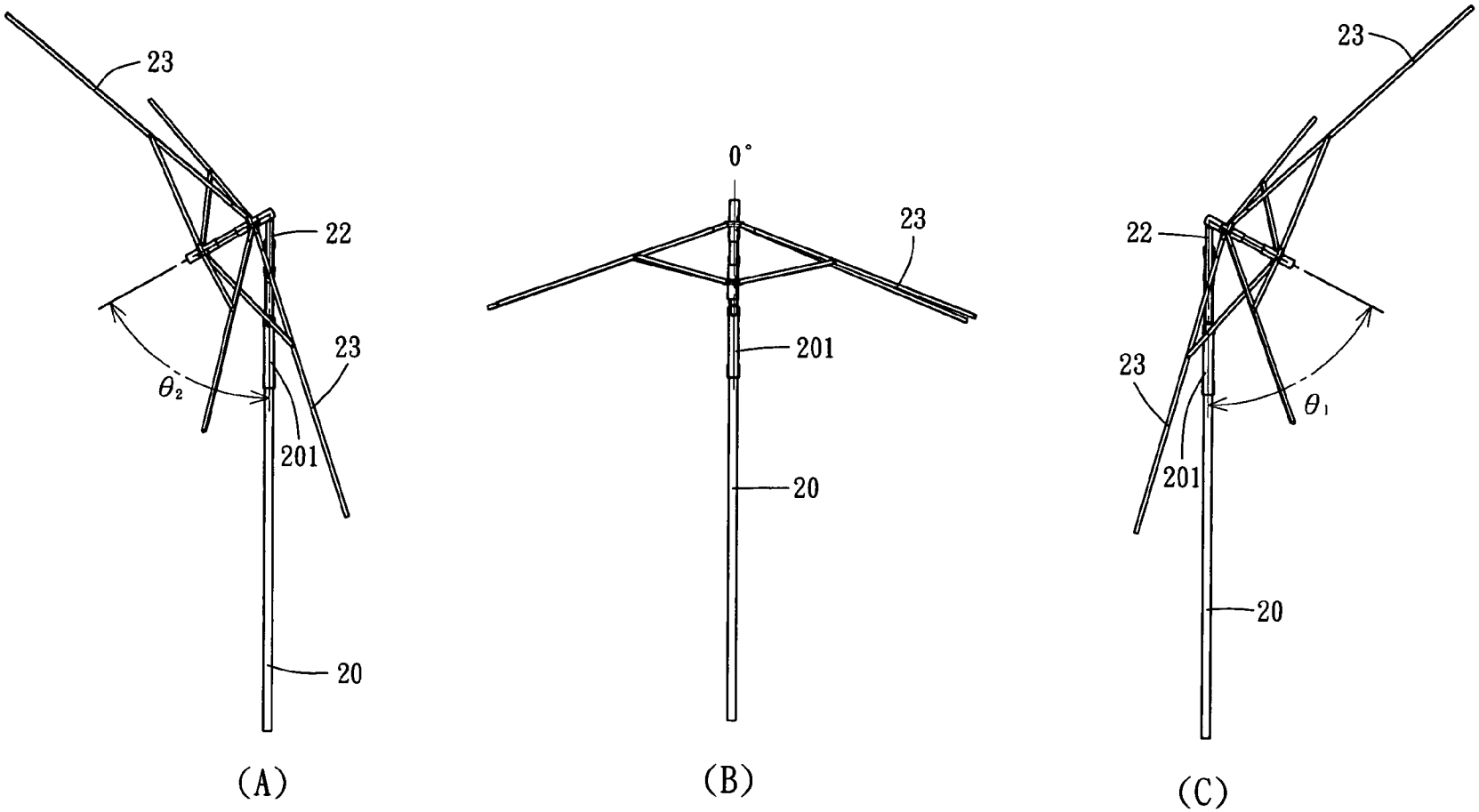
FIGS. 9A, 9B and 9C are other side cross-sectional views of the hang umbrella having its canopy adjusted in different angles in the present invention.

2. When the canopy 23 is to be adjusted and turned toward the left or the right side of the shank 20, only unscrew the tightening bolt 228 at the outer side of the right-sectional cantilever 22B. At this time, the canopy 23 and the left-sectional cantilever 22A can be turned around by hand to let the connecting plug 225 rotated in the interior of the right-sectional cantilever 22B, as shown in FIG. 9A and 9C. After the canopy 23 is adjusted to an appropriate angle, the tightening bolt 228 is screwed inward to tightly push against the connecting plug 225 for fixing the canopy 23 at its angle.

To sum up, this invention is able to adjust the canopy 23 of a hang umbrella to face or have its back facing the shank 20 and also able to turn the canopy 23 toward the left and the right side of the shank 20, having great practicability.

While the preferred embodiment of the invention has been described above, it will be recognized and understood that various modifications may be made therein and the appended claims are intended to cover all such modifications that may fall within the spirit and scope of the invention.

I claim:

1. An angle adjusting device for the canopy of a hang umbrella comprising:

A shank provided thereon with a slide ring, said slide ring able to be shifted up and down and positioned on said shank:

A pull rod having one end pivotally connected with the upper end of said shank:

A cantilever having one end pivotally connected with the side wall of said slide ring, said cantilever having the other end extending outward, said cantilever having its intermediate portion pivotally connected with the extending end of said pull rod, said pull rod able to pull upward the extending end of said cantilever to prevent it from falling down: and A canopy fixed at said extending end of said cantilever, said canopy facing downward: and, Characterized by said cantilever divided into a left-sectional cantilever and a right-sectional cantilever, a connecting plug inserted in between the interiors of said left-sectional and said right-sectional cantilever, said connecting plug having one end fitted in the interior of said left-sectional cantilever and secured therein, said connecting plug having the other end inserted and rotatably engaged in the interior of said right-sectional cantilever and positioned therein by a tightening bolt, said left-sectional cantilever being rotated relative to said right-sectional cantilever by disengaging of said tightening bolt, said cantilever having a hollow sleeve pivotally fitted around its intermediate portion, said cantilever inserted through said hollow sleeve and able to be rotated and adjusted in its angle in the interior of said hollow sleeve, said pull rod having its outer end pivotally connected with the upper side of said hollow sleeve.

2. The angle adjusting device for the canopy of a hang umbrella as claimed in claim 1, wherein said hollow sleeve has its inner wall formed with an annular recess and its outer wall bored with an insert hole communicating with said annular recess, a positioning bolt inserted in said insert hole of said hollow sleeve and connected with said cantilever, said positioning bolt having the other end positioned in said annular recess of said hollow sleeve for positioning said hollow sleeve on said cantilever, said cantilever able to be rotated and adjusted in its angle in the interior of said hollow sleeve.

3. The angle adjusting device for the canopy of a hang umbrella as claimed in claim 1, wherein said connecting plug has its outer wall bored with an annular recess at a location near said tightening bolt of said right-sectional cantilever, a connecting bolt inserted in said annular recess of said connecting plug from the outer side of said right-sectional cantilever, said connecting bolt able to prevent said connecting plug and said cantilever from disengaging from each other.

4. The angle adjusting device for the canopy of a hang umbrella as claimed in claim 1, wherein said canopy is formed with an upper rib holder provided in the center with a vertical combining tube having its upper opposite outer walls respectively bored with a vertical slide slot, an upper cover fitted around the upper portion of said vertical connecting tube, said upper cover composed of a vertical hollow main cover and a connecting tube extending outward obliquely from a side wall of said main cover, said connecting tube secured with said cantilever, said main cover having its upper interior fitted therein with a rope pulley by an insert pin, said main cover having its lower interior inserted therein with the upper end of said combining tube, a locking member inserted through the outer wall of said main cover and getting in said slide slot of said combining tube, a pull rope fastened with said slide ring, said pull rope passing through the interiors of said cantilever and said connecting tube and said rope pulley as well as said main cover and said combining tube and said upper rib holder of said canopy, said pull rope finally connected with a lower rib holder, said pull rope controlling an upper end of said combining tube and the main cover to be engaged with or disengaged from one another, and said upper and lower rib holders to be engaged and separated from one another.

* * * * *